US011602208B2

(12) United States Patent
Lo

(10) Patent No.: US 11,602,208 B2
(45) Date of Patent: Mar. 14, 2023

(54) HAIR DRYER

(71) Applicant: Airgle Corporation, Holbrook, NY (US)

(72) Inventor: Yang Zhen Lo, Flushing, NY (US)

(73) Assignee: AIRGLE CORPORATION, Holbrook, NY (US)

( * ) Notice: Subject to any disclaimer, the term of this patent is extended or adjusted under 35 U.S.C. 154(b) by 499 days.

(21) Appl. No.: 16/822,495

(22) Filed: Mar. 18, 2020

(65) Prior Publication Data

US 2021/0289908 A1 Sep. 23, 2021

(51) Int. Cl.
*A45D 20/12* (2006.01)

(52) U.S. Cl.
CPC ..... *A45D 20/122* (2013.01)

(58) Field of Classification Search
CPC ..... A45D 20/122; A45D 20/00; A45D 20/10; A45D 20/12
See application file for complete search history.

(56) References Cited

U.S. PATENT DOCUMENTS 4,230,279 A * 10/1980 Forsberg ..... A45D 20/122 285/332
4,683,369 A * 7/1987 Rieckman ..... A45D 20/12 219/121.73
5,612,001 A * 3/1997 Matschke ..... A61L 2/10 422/111
5,875,562 A * 3/1999 Fogarty ..... A45D 20/10 34/97
2015/0157106 A1* 6/2015 Atkinson ..... A46B 7/00 132/226
2016/0206074 A1* 7/2016 Douglas ..... A45D 20/12
2016/0367007 A1* 12/2016 Stephens ..... A45D 20/122
2017/0086558 A1* 3/2017 Kremp ..... A46B 15/001

FOREIGN PATENT DOCUMENTS

CN 212394157 U * 12/2019
CN 211608461 U * 1/2020
CN 111184333 A * 3/2020

* cited by examiner

*Primary Examiner* — Edelmira Bosques
*Assistant Examiner* — Bao D Nguyen
(74) *Attorney, Agent, or Firm* — Georgiy L. Khayet

(57) ABSTRACT

Provided is a hair dryer assembly. An example hair dryer assembly includes a housing and a handle. The housing has a side, an air outlet, and a rear opening. The handle is attached to the side of the housing. The hair dryer assembly further includes a heating wire disposed in the housing and an electric ventilator disposed in the handle. The hair dryer assembly further includes a magnetic ring recessed inside the air outlet of the housing and a diffuser removably attached, via the magnetic ring, to the air outlet of housing.

19 Claims, 16 Drawing Sheets

HAIR DRYER

TECHNICAL FIELD

This disclosure generally relates to hair appliances, and more particularly to hair dryers.

BACKGROUND

Hair dryers are popular appliances for home and salon hair care. Even though a variety of hair dryers is currently available on the market, finding a hair dryer that efficiently performs all required functions may be difficult. In particular, hair dryers that promise to dry hair fast usually tend to damage the hair because the fast drying is achieved by making the exhaust air extremely hot. Moreover, the fast-drying hair dryers usually have powerful motors, which makes the hair dryers large, heavy, and uncomfortable. On the other hand, hair dryers that purport to be gentle, need more time to dry the hair.

Hair dryers typically accomplish their main function well, i.e. drying hair, but can be less effective for styling purposes. Thus, a user may need to use additional tools in combination with the hair dryer, for example, specific hairbrushes, to curl or straighten the hair while the hair is drying, or even utilize other electric devices, such as curling or straightening irons, after the hair is dried with a hair dryer.

SUMMARY

This section is provided to introduce a selection of concepts in a simplified form that are further described below in the Detailed Description section. This summary is not intended to identify key features or essential features of the claimed subject matter, nor is it intended to be used as an aid in determining the scope of the claimed subject matter.

According to one example embodiment, a hair dryer assembly is provided. The hair dryer assembly may include a housing and a handle. The housing may have a side, an air outlet, and a rear opening. The handle may be attached to the side of the housing. The hair dryer assembly may further include a heating wire disposed in the housing and an electric ventilator disposed in the handle. The hair dryer assembly may further include a magnetic ring recessed inside the air outlet of the housing and a diffuser removably attached, via the magnetic ring, to the air outlet of housing.

According to another example embodiment, a method for providing a hair dryer assembly is provided. The method may include providing a housing and a handle. The housing may include a side, an air outlet, and a rear opening. The handle may be attached to the side of the housing. The method may further include disposing a heating wire inside the housing and disposing an electric ventilator inside the handle. The method may further include recessing a magnetic ring inside the air outlet of the housing and providing a diffuser configured to be removably attached, via the magnetic ring, to the air outlet of housing.

Additional objects, advantages, and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

Embodiments are illustrated by way of example and not limitation in the figures of the accompanying drawings, in which like references indicate similar elements and in which.

DETAILED DESCRIPTION

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

Embodiments of this disclosure generally relate to hair appliances, and, more particularly, to hair dryers. Some embodiments of the present disclosure provide a hair dryer assembly. The hair dryer assembly includes a housing and a handle attached to a side of the housing. Both the housing and the handle may be of a cylindrical shape. The handle may have a first end and a second end. An air inlet may be located at a first end of the handle. The second end of the handle can be connected to the side of the housing such that the handle is attached orthogonally to the side of the housing. A longitudinal axis of the housing can be perpendicular to a longitudinal axis of the handle. The hair dryer assembly can further include an electric ventilator disposed in the handle. The electric ventilator can propel the air from the air inlet at the first end of the handle to the second end of the handle with further passing of the air to the housing and to an air outlet located at a first end of the housing. The housing can further have a second end with an opening for attaching a cover to the housing. The hair dryer assembly further includes a heating wire disposed in the housing for heating the air passing through the housing to the air outlet. The housing may further have a magnetic ring recessed inside the air outlet of the housing. The magnetic ring may be used to removably attach a diffuser to the air outlet of housing. The diffuser may be configured as an air concentrator or an air splitter. The housing may further accommodate a printed circuit board. Additionally, a protective grid may be disposed at the first end of the housing. The handle may further accommodate control elements and have openings for buttons of the control elements.

Figure 1:
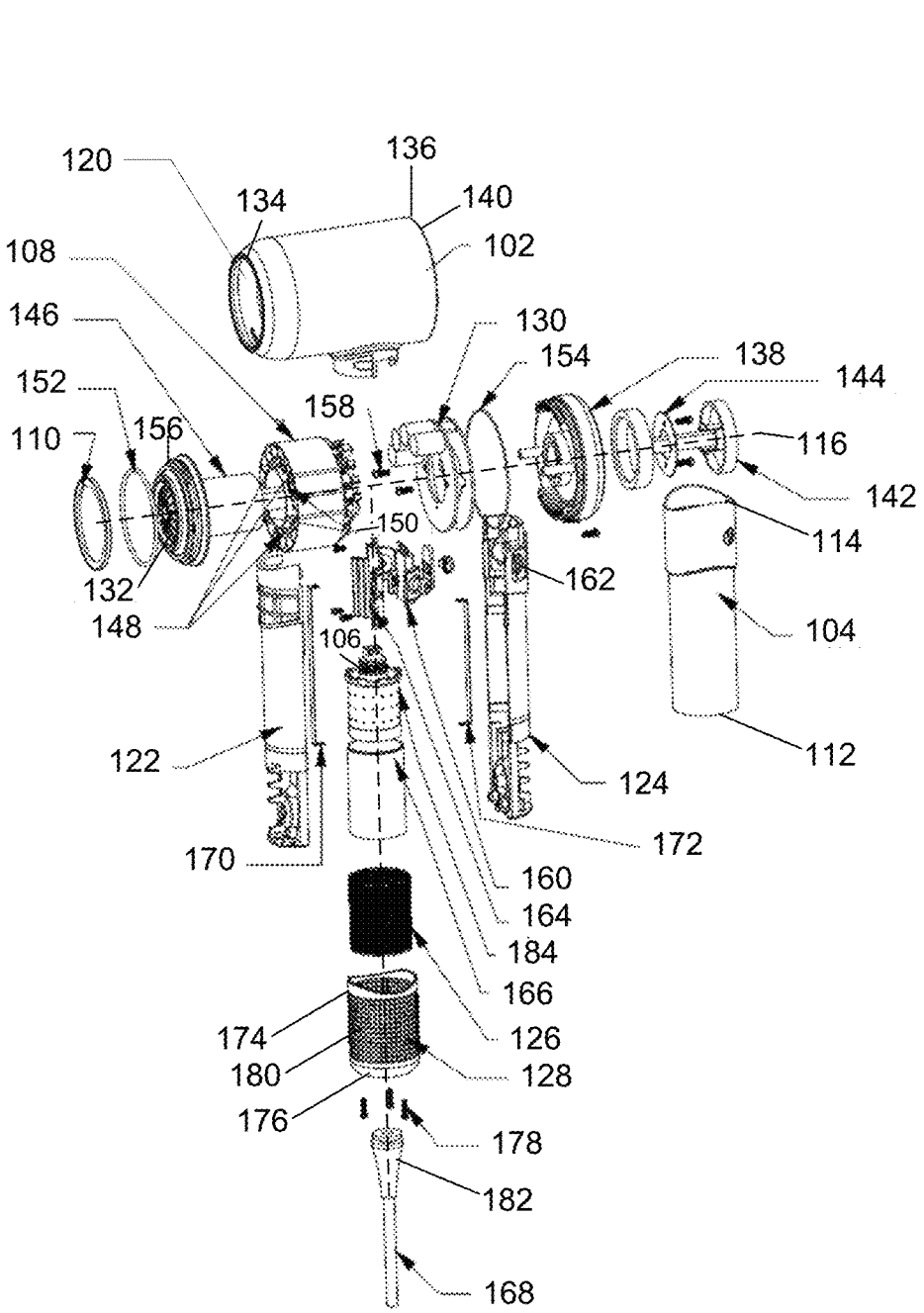
FIG. 1 is an exploded view of an example hair dryer assembly, according to an example embodiment.

Referring now to the drawings, FIG. 1 is an exploded view of a hair dryer assembly 100, according to one example embodiment of the present disclosure. The hair dryer assembly 100 may include a housing 102, a handle 104, an electric ventilator 106 disposed in the handle 104, a heating wire 108 disposed in the housing 104, and a magnetic ring 110 recessed inside an air outlet 120 of the housing 102. The handle 104 and the housing 102 may have a cylindrical shape. The handle 104 may have a first end 112 and a second end 114. The handle 104 may be connected by the second end 114 of the handle 104 to a side of the hosing 102 such that a longitudinal axis 116 of the housing 102 is perpendicular to a longitudinal axis 118 of the handle 104.

In an example embodiment, the handle 104 has an inner housing disposed inside the handle 104 and consisting of a first housing part 122 and a second housing part 124 each having a half-cylindrical shape and facing each other. The handle 104 may accommodate the electric ventilator 106. A rotational axis of the electric ventilator 106 may coincide with a central axis of the handle 106.

The electric ventilator 106 may have a motor and an impeller described in more detail with reference to FIG. 2. The electric ventilator 106 may be placed inside a gasket 184. The electric ventilator 106 and the gasket 184 may be enclosed within a motor hold 166 adopted to fix the electric ventilator 106 inside the handle 104.

The electric ventilator 106 may be configured to forward an air flow from an air inlet 128 located at the first end 112 of the handle 104 (i.e., a lower end of the handle 104) to the heating wire 108 disposed inside the housing 102. A filter 126 may be attached to the air inlet 128 at the first end 112 of the handle 104 to filter incoming air. In an example embodiment, the filter 126 is a High Efficiency Particulate Air (HEPA) filter. The filter 126 may be used to provide a more uniform distribution of the air volume and to filter foreign particles which may cause discomfort, especially to users with asthma.

The air inlet 128 may have a cylindrical portion 174 and an end portion 176. The end portion 176 may be attached to the cylindrical portion 174 via screws 178. The cylindrical portion 174 may have a plurality of opening 180 for letting the air flow into the air inlet 128.

The housing 102 may accommodate the heating wire 108, a printed circuit board 130, and a protective grid 132 disposed at a first end 134 of the housing 102. A second end 136 of the housing 102 may be closed with a first rear cover 138. The first rear cover 138 may be assembled to the housing 104 at a rear opening 140 at the second end 135 of the housing 102 by screwing. The first rear cover 138 may have a central opening. A second rear cover 142 may be inserted into the central opening of the first rear cover 138 to secure the first rear cover 138 to the housing 102 at the rear opening 140. A display 144, such as a light-emitting diode (LED) display, may be inserted between the first rear cover 138 and the second rear cover 142. The second rear cover 142 may have an opening such that the display 144 may be visible through the opening.

The first rear cover 138 may be assembled to the housing 104 by rotating the first rear cover 138, and can be removed (or disassembled) normally by rotating in a different direction. The second rear cover 142 may be attached to the first rear cover 138 by inserting, or partially inserting, which can prevent the first rear cover 138 from being disassembled. Therefore, such structure of two covers prevents users from opening the first rear cover 138 of the hair dryer assembly 100 and touching the printed circuit board 130 and causing hazards or danger. In an example embodiment, a logo or a picture may be placed onto the second rear cover 142.

The housing 102 may further have an inner housing portion 146. The inner housing portion 146 may have an elongated cylindrical shape so that the heating wire 108 and the printed circuit board 130 may be slipped over the inner housing portion 146 to prevent movement of the heating wire 108 and the printed circuit board 130 inside the housing 102. The printed circuit board 130 may have a plurality of elements, such as resistors, transistors, capacitors, an integrated circuit, a controller, and other elements for controlling an operation of the hair dryer assembly 100. The heating wire 108 may have temperature protection resistors 148 and thermistors 150 disposed on the heating wire 108.

An O-ring 152 may be placed between the inner housing portion 146 and the magnetic ring 110 to accommodate the magnetic ring 110 tightly in a recess 156 of the inner housing portion 146. Furthermore, an O-ring 154 may be placed between the printed circuit board 130 and the first rear cover 138 to prevent the movement of the printed circuit board 130 along the longitudinal axis 116 of the housing 102. The printed circuit board 130 may be connected to the first rear cover 138 via screws 158.

The axis of the electric ventilator 106 may be the same as the centerline of the handle 104. When the motor exceeds 50,000 rpm and the hair dryer assembly is in use, the centrifugal force will be generated if the motor and the handle are not concentric. So, the user needs to apply more force to overcome the centrifugal force of the motor when using the hair dryer assembly. As the electric ventilator 106 and the handle 104 have a concentric structure, the centrifugal force generated by the motor at high speed may be reduced to optimize the force needed by a hand of the user to hold the hair dryer assembly. In an example embodiment, the motor may reach a maximum of 100,000 rpm to provide strong airflow and ensure strong wind pressure with large air volume.

The handle 104 further accommodates a switch. The switch may include several control elements, in particular, a slide switch 160 and buttons (shown in FIG. 5). The second housing part 124 may have openings 162 for the slide switch 160 and the buttons. The handle 104 further has a pressure plate 164 configured to fix the slide switch 160 and buttons to the handle 104.

The power supply to the components of the hair dryer assembly 100 may be provided by a power cord 168 connected to the air inlet 128 at the first end 112 of the handle 104. The power cord 168 may have a strain relief 182 to secure the power cord 168 to the air inlet 128 of the handle 104. The strain relief 182 provides a seal on a power cord entry and reduces wire stress at a connection point of the power cord 168.

A wire (not shown) may be used to supply power from the power cord 168 to the electric ventilator 106. To supply power to other components of the hair dryer assembly 100, such as the printed circuit board 130, the heating wire 108, the switch, the display 144, and any other components, two metal shrapnel plates shown as a first metal shrapnel plate 170 and a second metal shrapnel plate 172 may be used. In an example embodiment, the first metal shrapnel plate 170 may be molded into a first part of the handle 104, i.e., into an inner side of the first housing part 122, and the second metal shrapnel plate 172 may be molded into a second part of the handle 104, i.e., into an inner side of the second housing part 124 standing opposite to the first part. In a further example embodiment, the first metal shrapnel plate 170 and the second metal shrapnel plate 172 may be molded onto an outer surface of the motor hold 166.

The first metal shrapnel plate 170 and the second metal shrapnel plate 172 may be made of a metal sheet. The height of the metal sheet may be smaller than the height of parts into which the first metal shrapnel plate 170 and the second metal shrapnel plate 172 are molded. Wires (cables) conventionally used for supplying power between the elements, such as from a power cord to any elements of the hair dryer assembly 100, have some predetermined a diameter of the wire. In view of this, a space may be needed to accommodate the wires, for example, a space between inner sides of the handle and the motor hold 166. In the present disclosure, as the first metal shrapnel plate 170 and the second metal shrapnel plate 172 molded into the inner sides of the first housing part 122 and the second metal shrapnel plate 172 are used instead of wires, no space for the wire is needed between the handle and the motor hold 166. In this way, the diameter of the handle 104 can be reduced to make the use of the hair dryer assembly 100 more comfortable for a user when the user holds the hair dryer assembly 100 in his hand.

At least one wire may connect the power cord 168 and a first end of the first metal shrapnel plate 170. At least one further wire may connect a second end of the first metal shrapnel plate 170 and any of the printed circuit board 130, the heating wire 108, the switch, and the display 144 so as to provide the power from the power cord 168 to any of the printed circuit board 130, the heating wire 108, the switch, and the display 144. Similarly, at least one wire may connect the power cord 168 and a first end of the second metal shrapnel plate 172. At least one further wire may connect a second end of the second metal shrapnel plate 174 and any of the printed circuit board 130, the heating wire 108, the switch, and the display 144 so as to provide the power from the power cord 168 to any of the printed circuit board 130, the heating wire 108, the switch, and the display 144.

Figure 2:
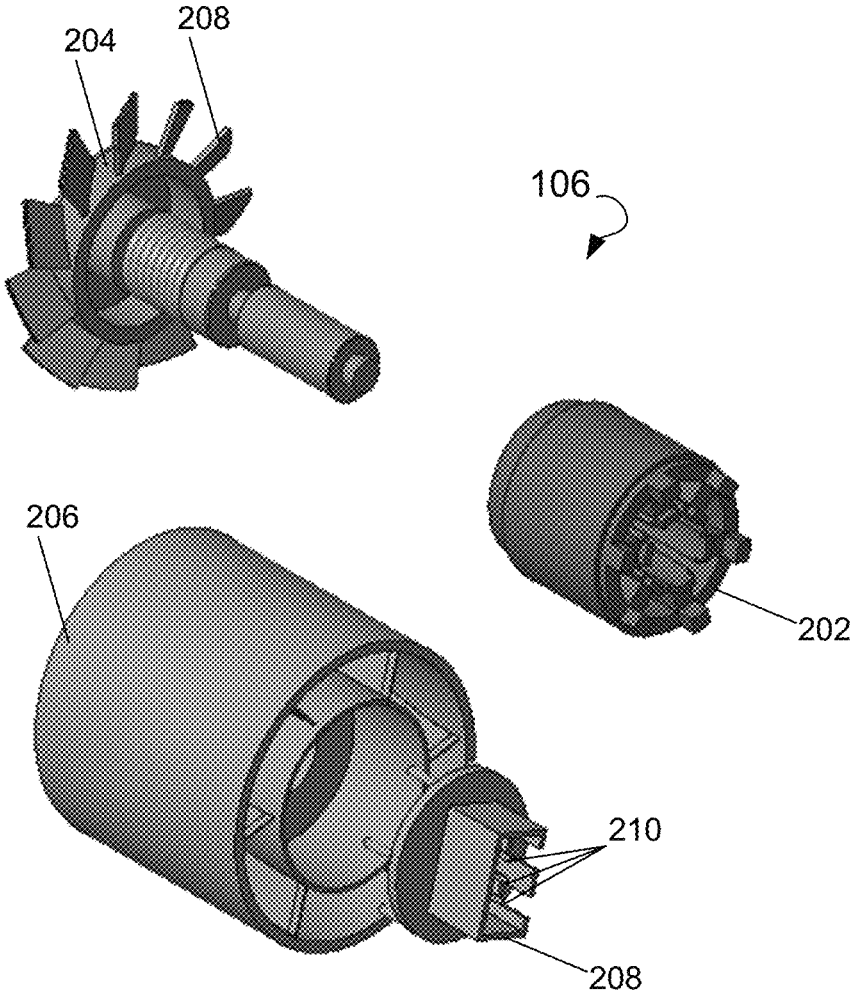
FIG. 2 is an exploded view of an electric ventilator, according to an example embodiment.

FIG. 2 is an exploded view of the electric ventilator 106, according to an example embodiment. The electric ventilator 106 may have a motor 202, an impeller 204, and a body 206 for accommodating the motor 202 and the impeller 204. An end portion 208 may be attached to one end of the body 206. The end portion 208 may have contact rods 210. A wire (not shown) may connect the contact rods 210 to the power cord to supply power to the electric ventilator 106. In an example embodiment, the motor 202 may include a circular rotor. The impeller 204 may have a plurality of blades 208. The number of blades may be selected to provide the optimal performance of the impeller 204 and may be, for example, 11 blades.

Figure 3:
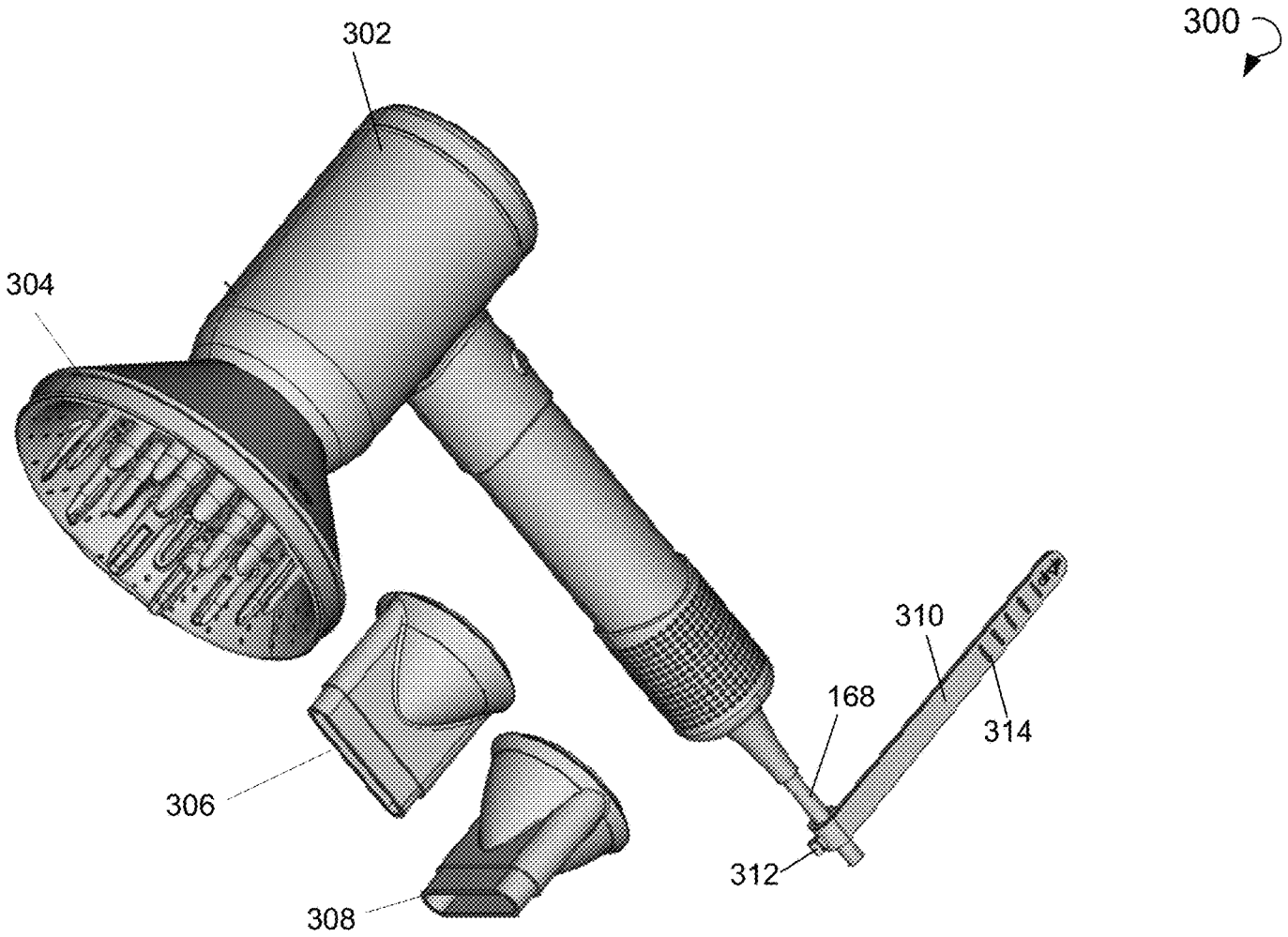
FIG. 3 is a front perspective view of a hair dryer assembly, according to an example embodiment.

FIG. 3 is a front perspective view 300 of the hair dryer assembly 100, according to an example embodiment. The hair dryer assembly 100 includes a hair dryer 302 the elements of which are described in detail with reference to FIG. 1. The hair dryer assembly 100 further includes a plurality of diffusers 304, 306, 308. A fastening strip 310 may be attached to the power cord 116. The fastening strip 310 may have a projection 312 disposed on a portion enclosing the power cord 116, and may further have a plurality of openings 314. The fastening strip 310 may be looped by bending the fastening strip 310 and inserting the projection 312 into one of the openings 314. When looped, the fastening strip 310 may be used to hold the power cord 116 in a bended state for the case the shorter length of the power cord 116 is needed or when the hair dryer assembly 100 is not in use and is placed into a storage.

Figure 4:
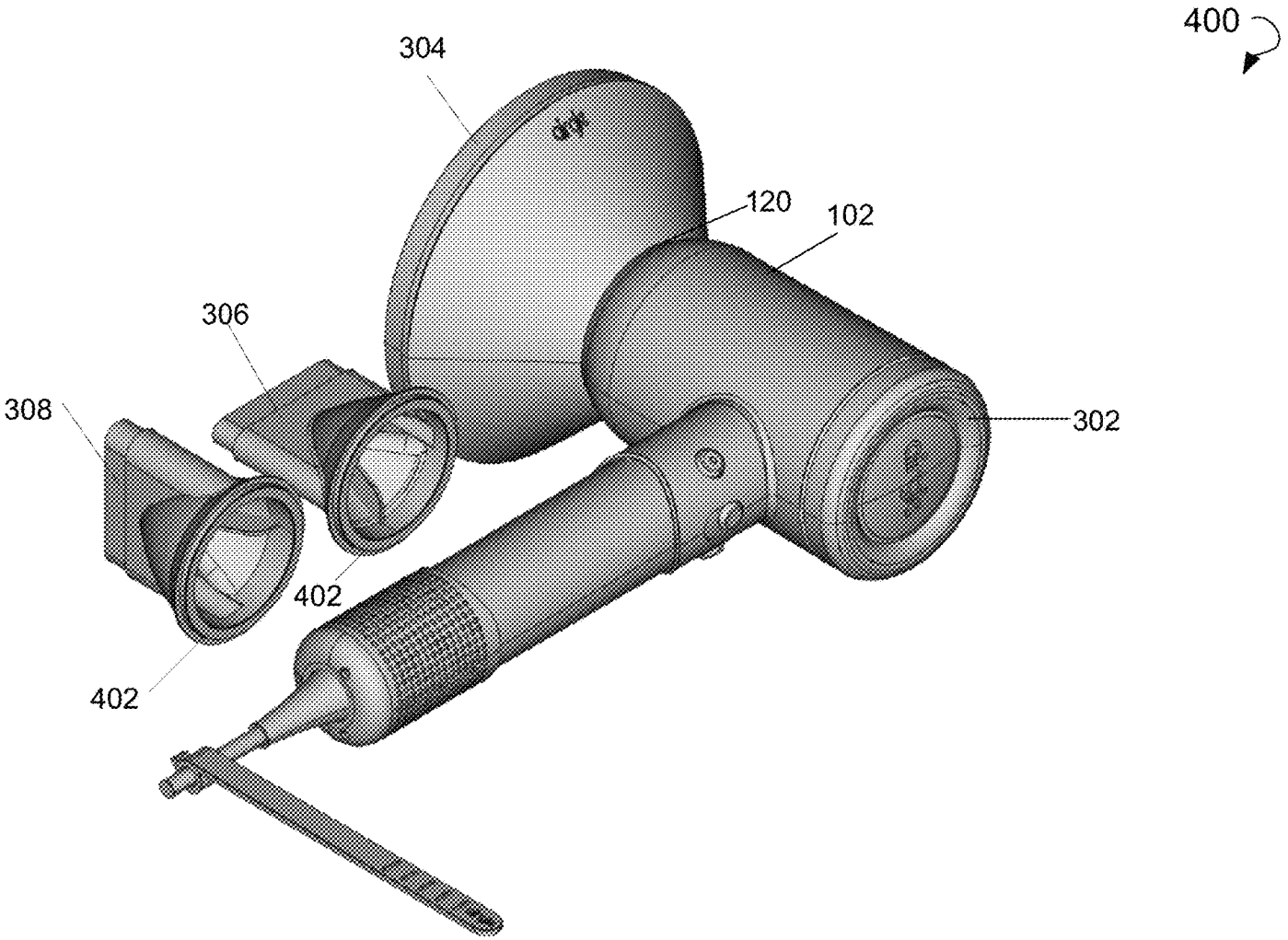
FIG. 4 is a rear perspective view of a hair dryer assembly, according to an example embodiment.

FIG. 4 is a rear perspective view 400 of the hair dryer assembly 100, according to an example embodiment. Each of the diffusers 304, 306, 308 may have a metal ring 402 for attaching to a magnetic ring (a magnetic ring 110 shown in FIG. 1) at an air outlet of the housing 102.

Figure 5:
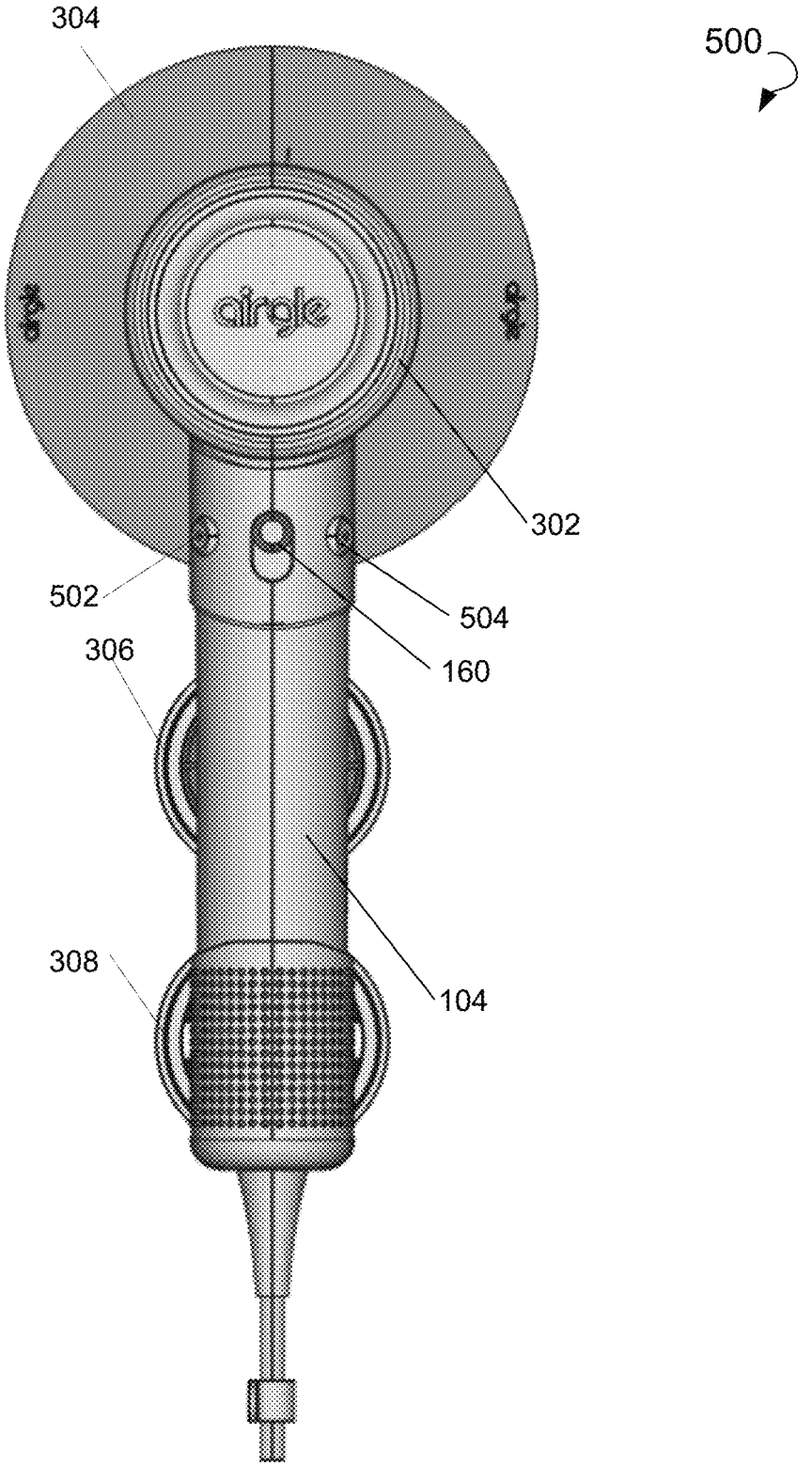
FIG. 5 is a rear view of a hair dryer assembly, according to an example embodiment.

FIG. 5 is a rear view 500 of the hair dryer assembly 100, according to an example embodiment. The handle 104 may accommodate a slide switch 160 and buttons 502, 504. The slide switch 160 and buttons 502, 504 may be used to control modes of operation of the hair dryer assembly 100, such as temperature, ionization, hot/cold air, and the like.

Figure 6:
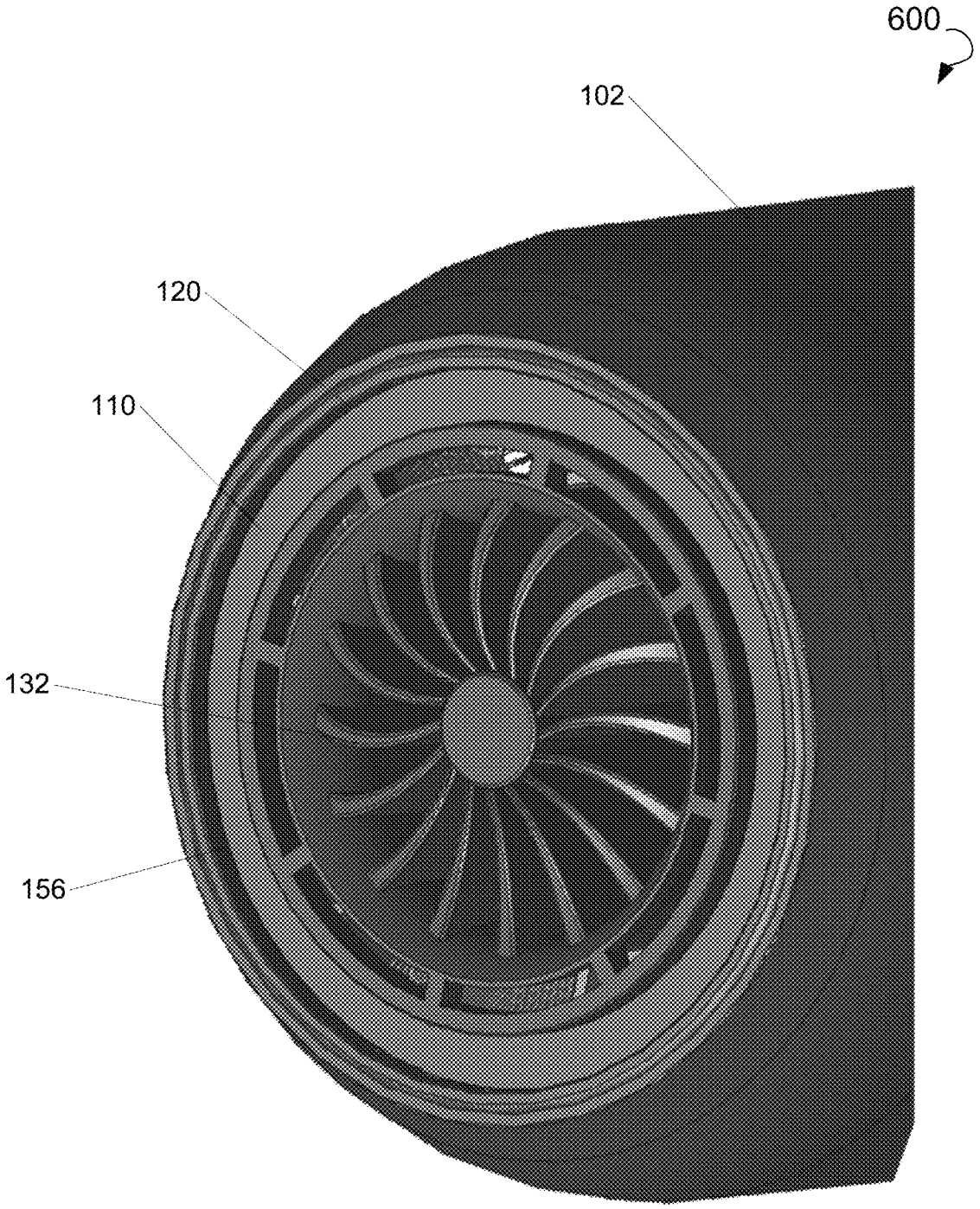
FIG. 6 is a partial view of a housing of a hair dryer assembly showing an air outlet, according to an example embodiment.

FIG. 6 is a partial view 600 of the housing 102 of the hair dryer assembly 100 showing an air outlet 120, according to an example embodiment. The magnetic ring 110 is recessed in a recess 156 made in an air outlet 120 of the housing 102. The protective grid 132 may be located at the air outlet 120 of the housing 102 to prevent inappropriate items from entering the housing 102.

After the hair dryer assembly is turned on and the highest heating is used for about three minutes, the magnetic ring 110 on an end face of the air outlet 120 may heat up and may burn a skin of the user if the magnetic ring 110 is accidentally touched to the skin when using the hair dryer assembly. Placing the magnetic ring 110 in the recess 156 provides avoiding the problem (or hazard) of burning the skin due to the excess heat on the magnetic ring 110 disposed at the air outlet 120.

Figure 7B:
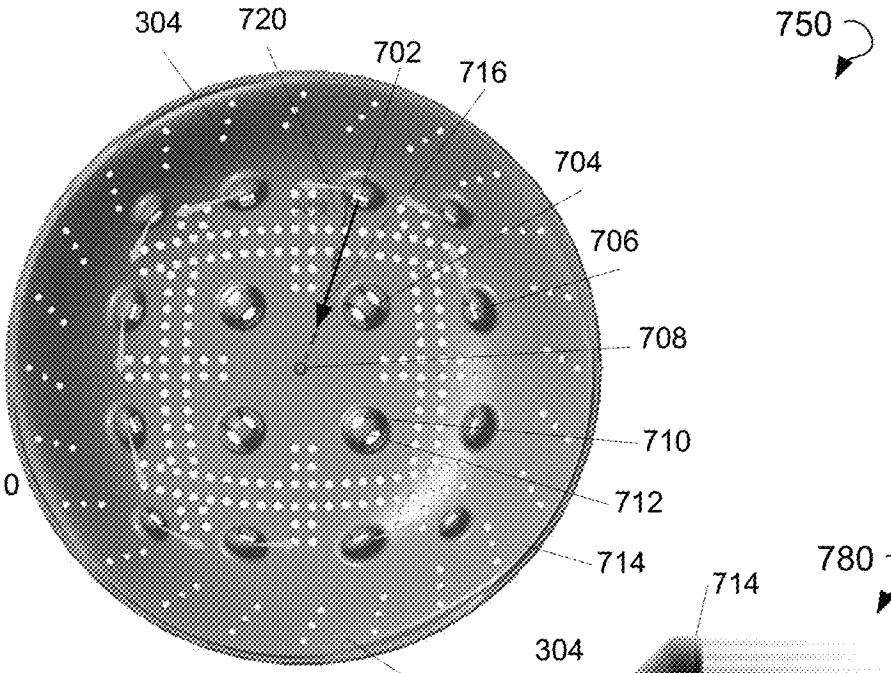
FIGS. 7A and 7B are front views of a diffuser, according to an example embodiment.
Figure 7A:
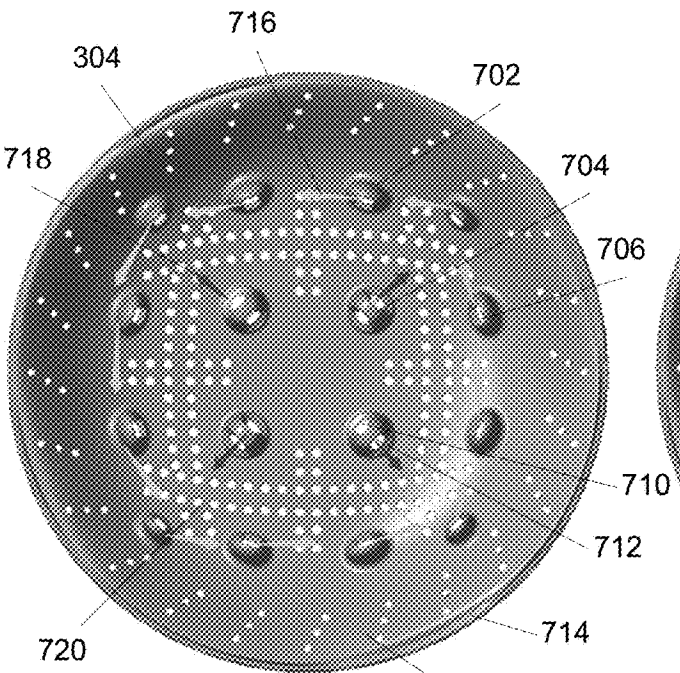
Figure 7D:
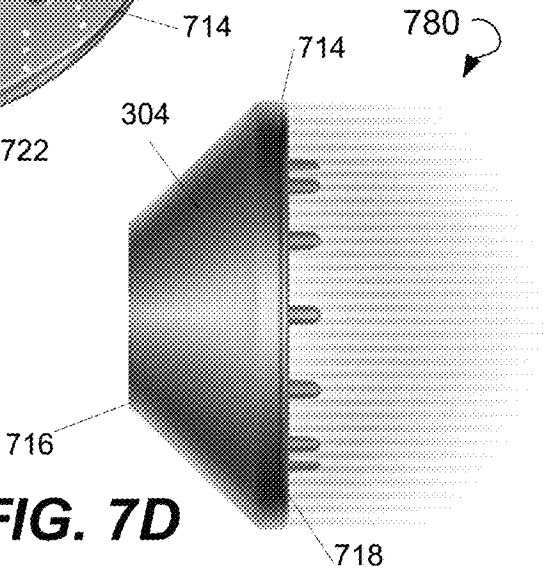
FIG. 7D is a side view of a diffuser, according to an example embodiment.
Figure 7C:
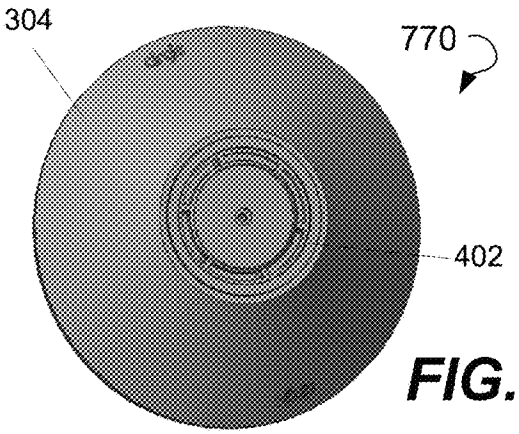
FIG. 7C is a rear view of a diffuser, according to an example embodiment.

FIGS. 7A and 7B are front views 700 and 750, respectively, of a diffuser 304. FIG. 7C is a rear view 770 of a diffuser 304. FIG. 7D is a side view 780 of a diffuser 304. The diffuser 304 may include an air inlet 716 (see FIG. 7D), an air outlet 718 (see FIG. 7D), and a high-efficiency particulate air filter 720 disposed between the air inlet 716 and the air outlet 718.

The diffuser may include a plate 722 and a plurality of nozzles 702, 704 extending orthogonally from the plate 722. The nozzles 702, 704 may include air flow outlets configured to form an air flow tangentially with respect to the plate 722 and around a central axis of the plate 722. Specifically, each of the plurality of nozzles 702 may have an opening 706 facing a center 708 of the plate 722. Each of the plurality of nozzles 704 may have an opening 710 facing the center 708 of the plate 722 and opening 712 facing a periphery 714 of the diffuser 304. When the air is blown from the nozzles 702 and nozzles 704, the air flow passes along the tangent direction of the periphery 714 of an outer circle of the diffuser 304. When the air flow 716 from the nozzles 702 and the air flow 718 from the nozzles 704 are blown together, a round wind shown by the air flow 720, which is similar to the characteristics of a tornado, is generated. Additionally, the plurality of nozzles 702, 704 may prevent water drops entering the housing of the hair dryer assembly. The diffuser 304 may have a metal ring 402 for attaching to a magnetic ring (a magnetic ring 110 shown in FIG. 1) at an air outlet of the housing 102.

FIG. 7D shows a direction and an angle of dispersion of the air flow from the diffuser 304. As can be seen in FIG. 7D, the air flow comes out linearly from the diffuser 304 without dispersing outside the periphery 714 of the diffuser 304.

Figure 8A:
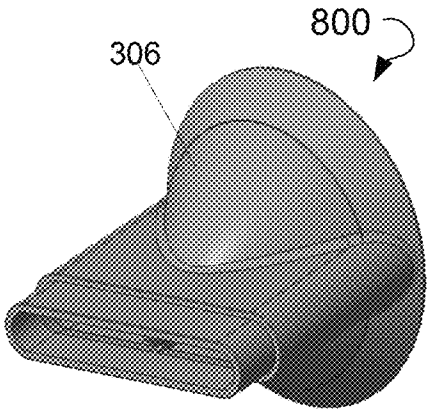
FIG. 8A is a front perspective view of a diffuser, according to an example embodiment.
Figure 8B:
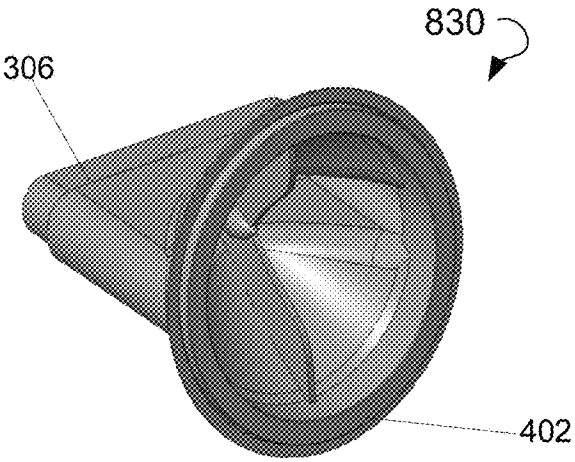
FIG. 8B is a rear perspective view of a diffuser, according to an example embodiment.

FIG. 8A is a front perspective view 800 of a diffuser 306. FIG. 8B is a rear perspective view 830 of the diffuser 306. The diffuser 306 may have a metal ring 402 for attaching to a magnetic ring (a magnetic ring 110 shown in FIG. 1) at an air outlet of the housing 102.

Figure 8C:
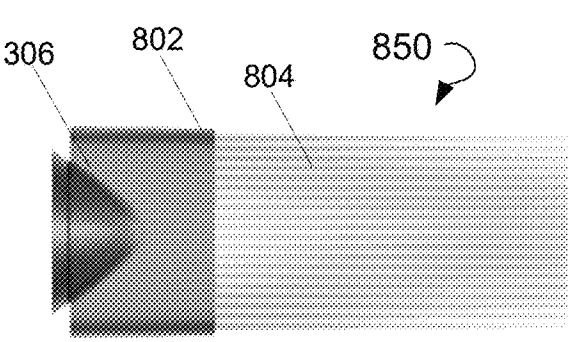
FIG. 8C is a side view of a diffuser.

FIG. 8C is a side view 850 of the diffuser 306. FIG. 8C shows a direction and an angle of dispersion of the air flow from the diffuser 306. As can be seen in FIG. 8C, the air flow comes out linearly from the diffuser 306 without dispersing outside the periphery 802 of the diffuser 306 to keep the air flow 804 focused. As the air flow 804 may be directed to an intended portion of the hair without disturbing the rest of the hair, the diffuser 306 may be used as a styling diffuser.

Figure 8D:
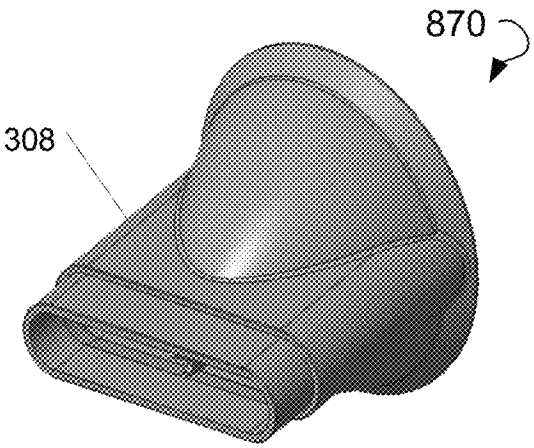
FIG. 8D is a front perspective view of a diffuser, according to an example embodiment.
Figure 8E:
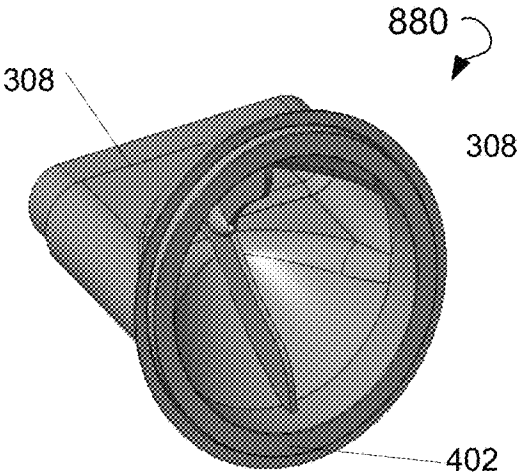
FIG. 8E is a rear perspective view a diffuser.

FIG. 8D is a front perspective view 870 of a diffuser 308. FIG. 8E is a rear perspective view 880 of the diffuser 308. The diffuser 308 may have a metal ring 402 for attaching to a magnetic ring (a magnetic ring 110 shown in FIG. 1) at an air outlet of the housing 102.

Figure 8F:
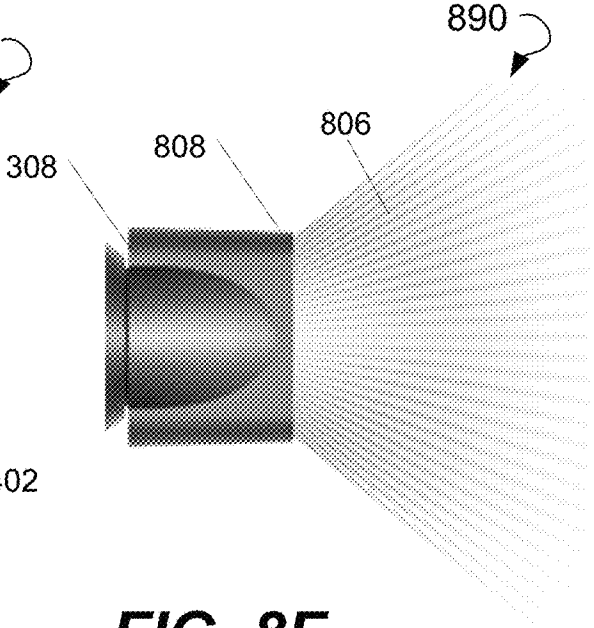
FIG. 8F is a side view of a diffuser.

FIG. 8F is a side view 890 of the diffuser 308. FIG. 8F shows a direction and an angle of dispersion of the air flow from the diffuser 308. As can be seen in FIG. 8F, when coming out from the diffuser 308, the air low 806 disperses outside the periphery 808 of the diffuser 306. As the air flow 806 is dispersed to a large portion of the hair, the diffuser 308 may be used as a smoothing diffuser for drying and styling simultaneously.

Figure 9A:
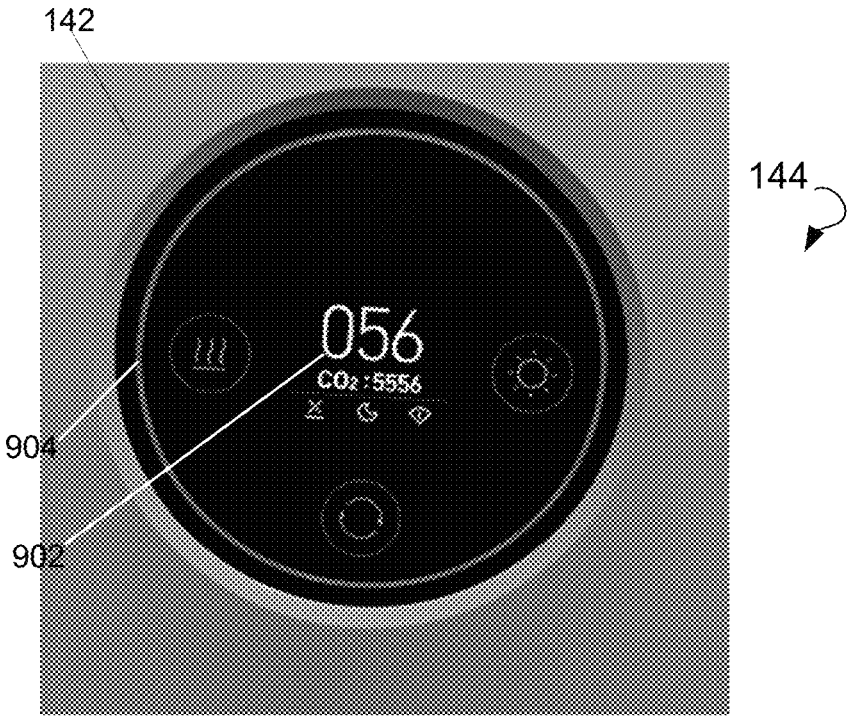
FIGS. 9A and 9B show a display disposed on a second rear cover, according to an example embodiment.
Figure 9B:
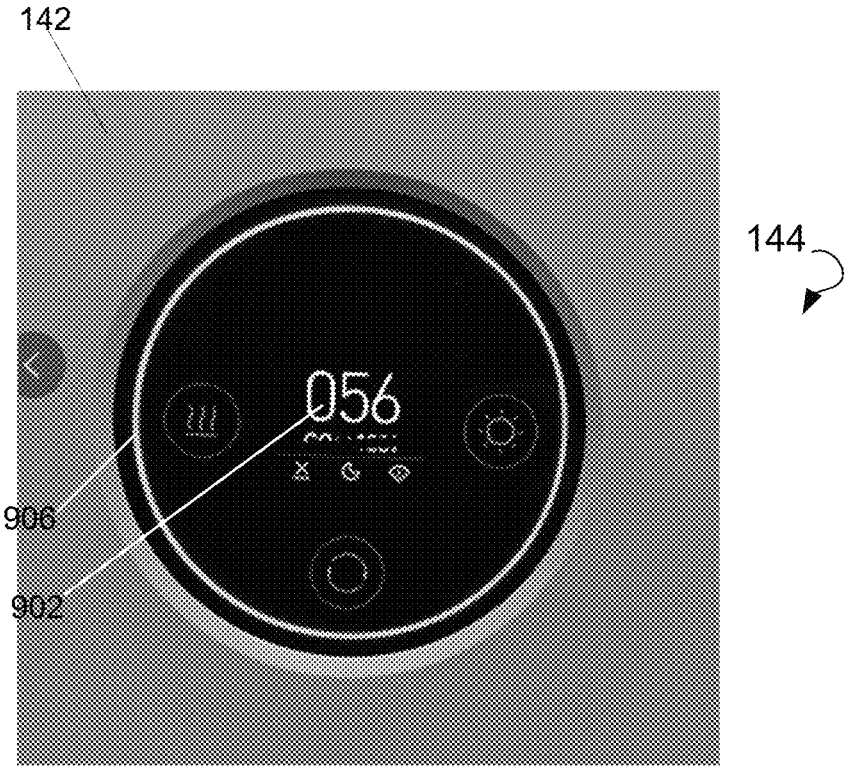

FIGS. 9A and 9B show a display 144 that may be attached to the second rear cover 142. The display 144 may include a LED display. The display 144 may show indications 902 associated with a current mode and operation of the hair dryer assembly. The display 144 may show a colored circle 904, 906 to provide notifications to a user. For example, the colored circle 904, 906 may be colored white or red depending on predetermined criteria. Displaying different colors of LED lights for the heating/normal temperature working status of the hair dryer assembly allows users to easily see the current working status of the hair dryer assembly.

Figure 10:
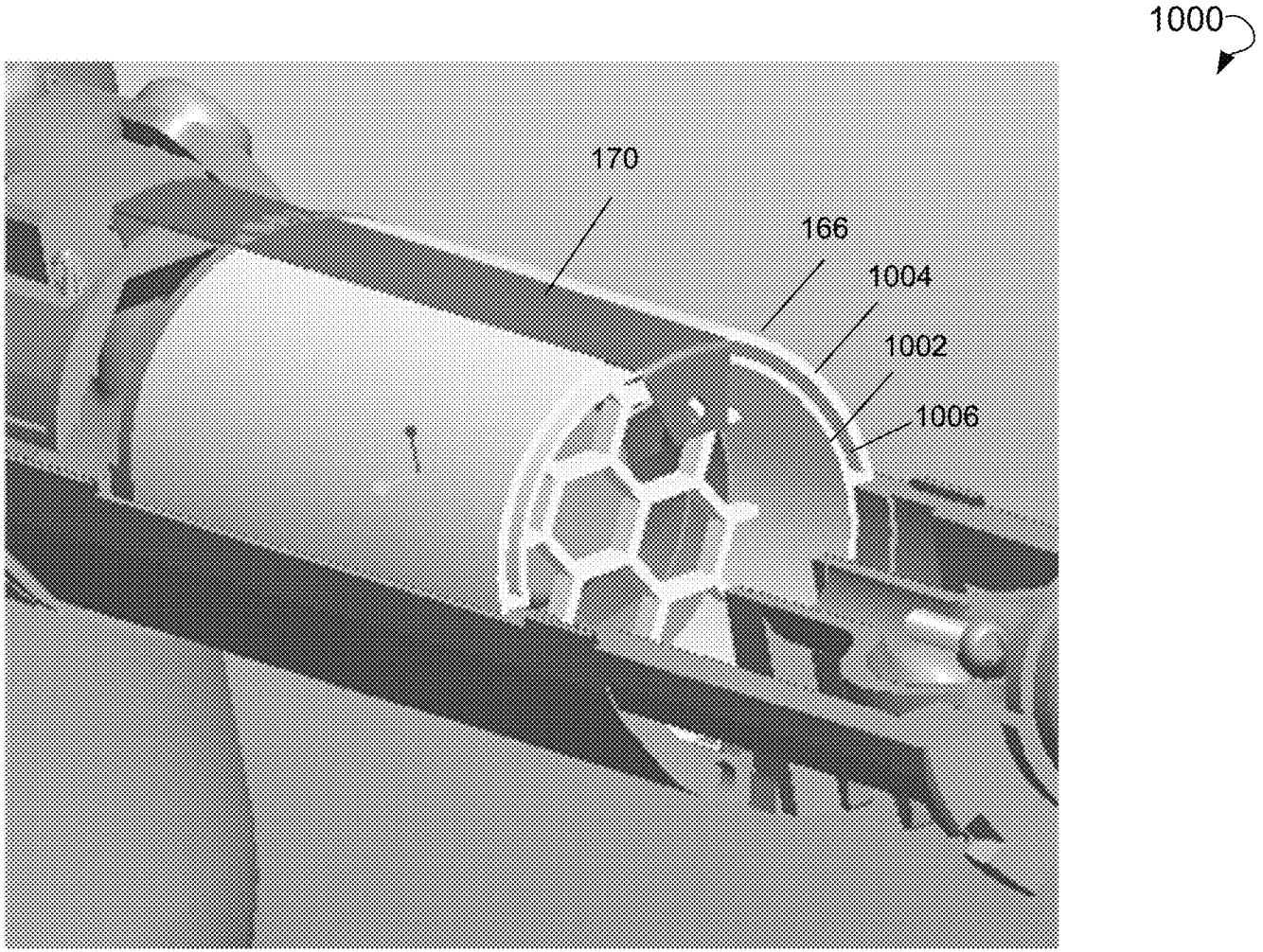
FIG. 10 is a perspective view of a motor hold and a first metal shrapnel plate, according to an example embodiment.

FIG. 10 is a perspective view 1000 of a motor hold 166 with a first metal shrapnel plate 170 contacting the motor hold 166. The first metal shrapnel plate 170 may be molded into an inner side of the first housing part 122 shown in FIG. 1. The first metal shrapnel plate 170 and, similarly, the second metal shrapnel plate 172, may be injected into the plastic parts (such inner sides of the first housing part 122 and the second housing part 124) by means of mold injection.

In an example embodiment, the motor hold 166, also referred to herein as a fixing ring, is configured to fix the electric ventilator within the handle and may have a double-ring structure for reducing noise of the electric ventilator. Specifically, A tail part of the fixing ring may adopt the double-ring structure consisting of an inner ring 1002 and an outer ring 1004, and a hollow 1006 between the inner ring 1002 and the outer ring 1004. The sound transmission path is as follows: air/plastic/air/plastic. Therefore, a multilayer structure provided by the inner ring 1002 and the outer ring 1004 is used to reduce the sound.

Figure 11:
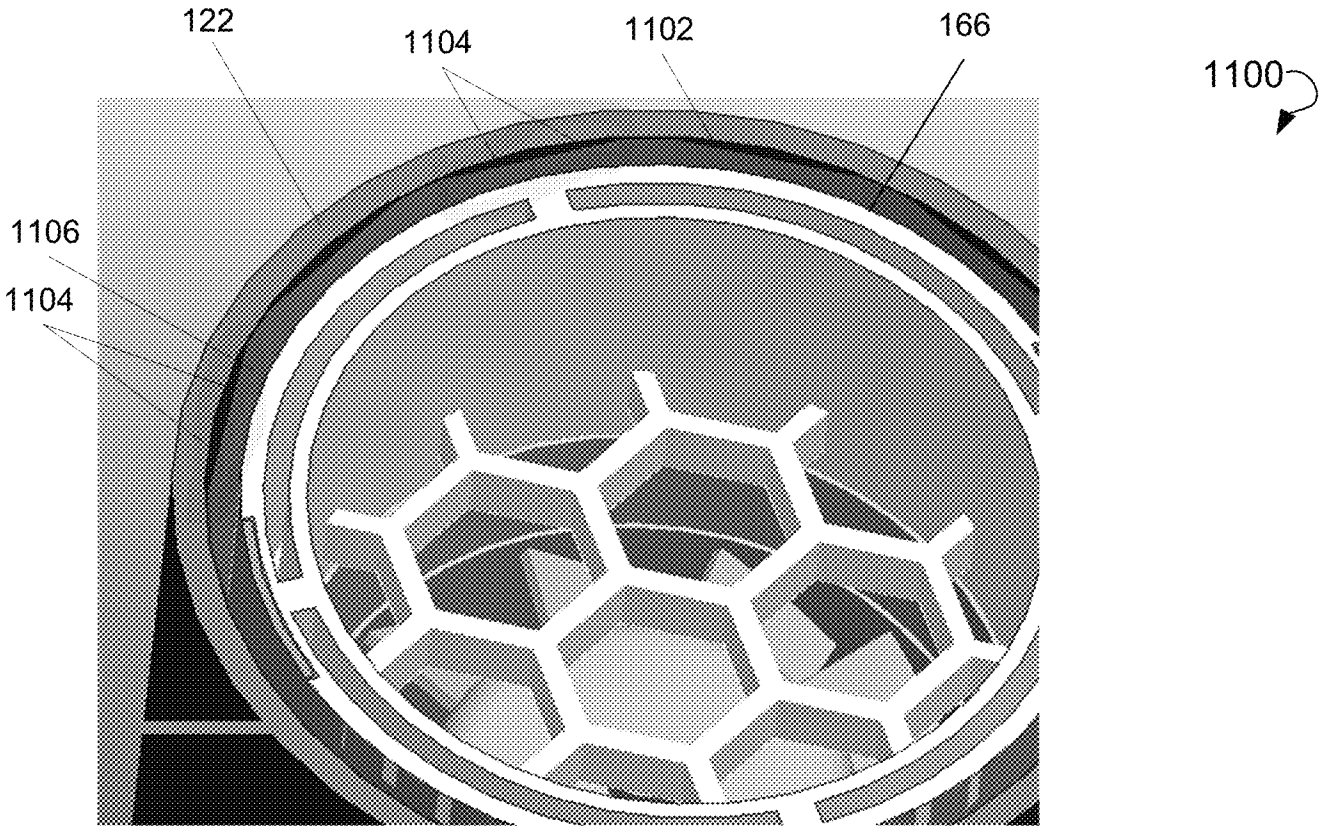
FIG. 11 is a partial view of a motor hold, a first housing part, and a second housing part, according to an example embodiment.

FIG. 11 is a partial view 1100 of the motor hold 166 and a first housing part 122 and a second housing part 124, according to an example embodiment. A shape of an inner wall of the handle may include concave arcs disposed around a central axis of the handle. The concave arcs may form a space to absorb a sound of the electric ventilator. Specifically, a number of concave arcs 1104 may be provided around an inner wall 1102 of the first housing part 122 and the second housing part. The inner surface of the first housing part 122 of the handle may have, for example, 10 planes to form a sound-absorbing (or reducing) structure. A gap 1106 between the concave surface of the concave arcs 1104 and the first housing part 122 of the handle is used to reduce the noise of the motor. When the sound of the motor comes out, the sound spreads as follows: air/plastic/air/plastic.

Figure 12B:
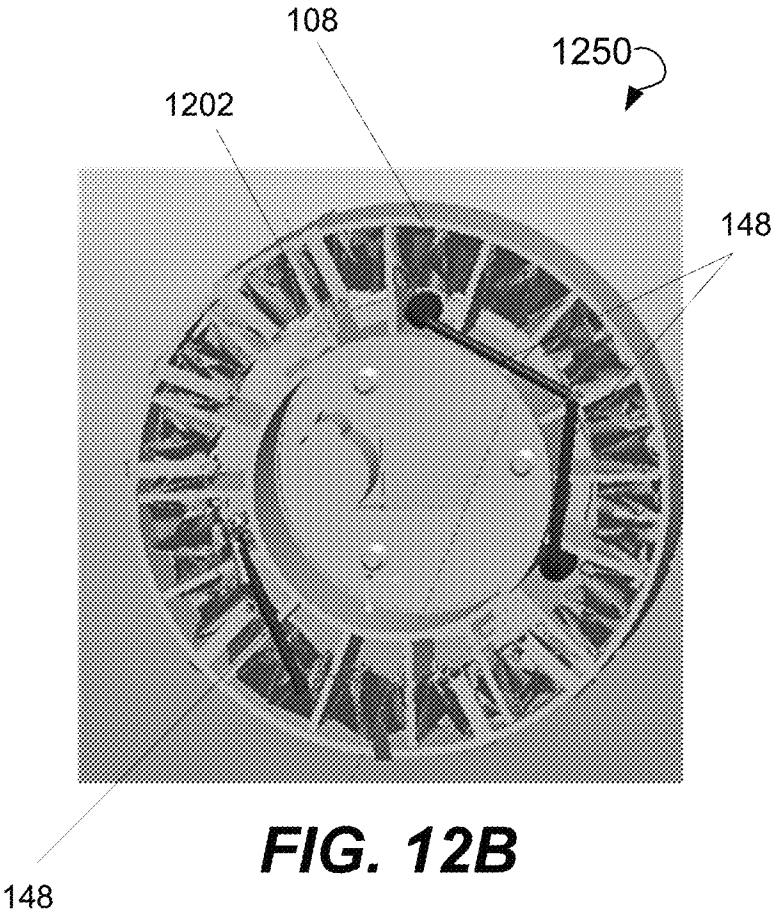
FIG. 12B is a front view of a heating wire, according to an example embodiment
Figure 12A:
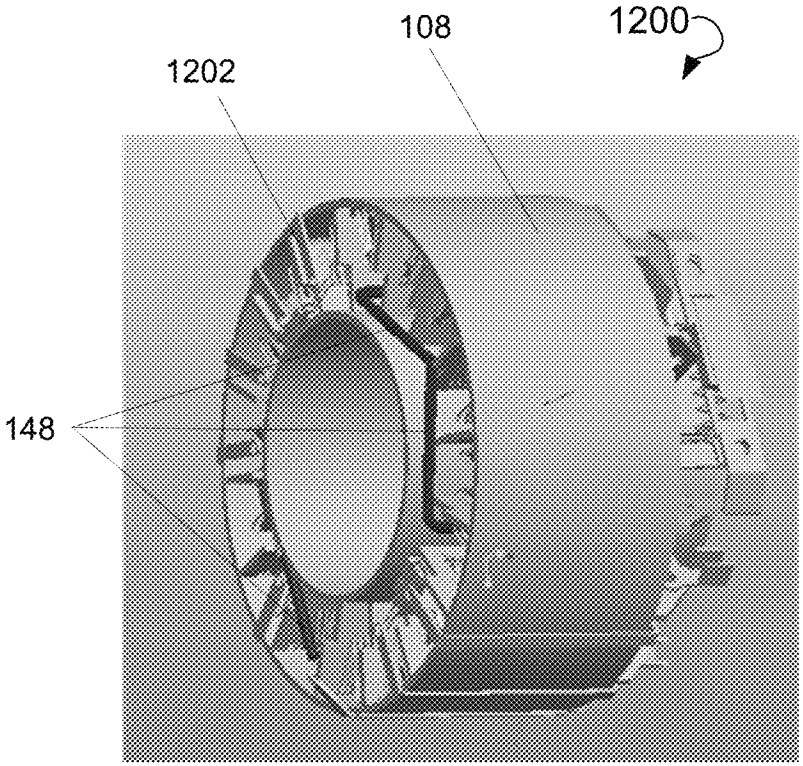
FIG. 12A is a perspective view of a heating wire, according to an example embodiment.

FIG. 12A is a perspective view 1200 of the heating wire 108. FIG. 12B is a front view 1250 of the heating wire 108. Three temperature protection resistors 148 may be disposed on a front surface 1202 (or any other portion) of the heating wire 108 around an axis of the heating wire 108 with 120 degree from each other. The temperature protection resistors 148 may be configured to monitor the temperature of the heating wire 108 and prevent the heating wire 108 from overheating. When the heating wire 108 works abnormally, the local temperature is too high. The temperature protection resistors 148 may work to avoid the temperature being too high and causing harm to the elements of the hair dryer assembly.

Figure 13:
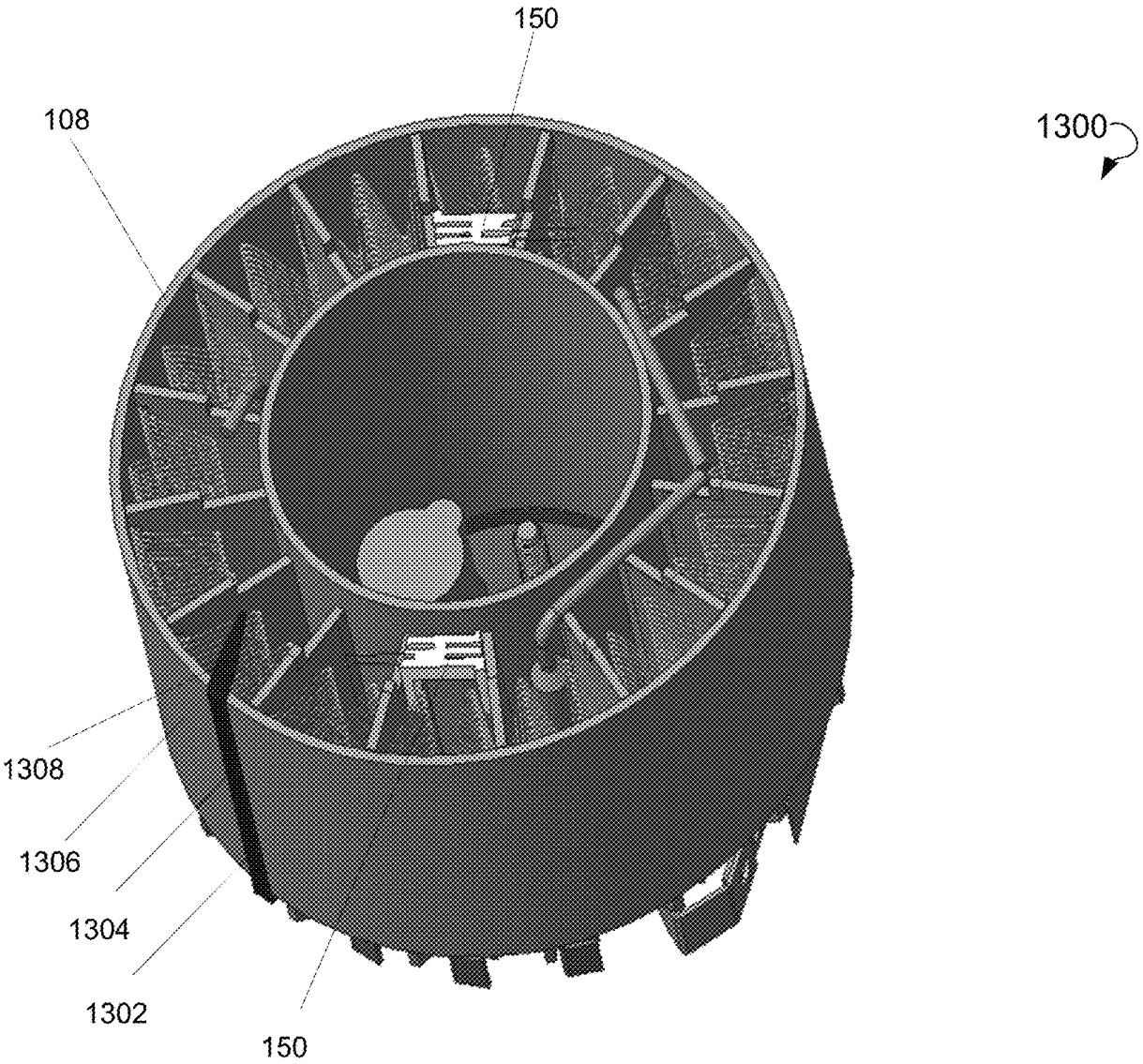
FIG. 13 is a perspective view of a heating wire, according to an example embodiment.

FIG. 13 is a perspective view 1300 of the heating wire 108. Two thermistors 150 may be placed on the heating wire 108 at an air outlet of the heating wire. The thermistors 150 may be platinum thermistors and may be used to sense temperatures to control the temperature more accurately and control the temperature within a predetermined range. The thermistors 150 may be connected to the printed circuit board.

The resistance value at the air outlet of the heating wire 108 is measured (or tested) by the one of the thermistors 150. The measured resistance value is passed to a microcontroller unit (a controller) located on the printed circuit board. The microcontroller unit uses a predetermined algorithm to convert the measured resistance value to the temperature of the air flow at the air outlet. For example, if the temperature air flow at the air outlet is too high or too low, the microcontroller unit controls the working state (on/off) of the heating wire 108 by using the confirmed data generated by the resistance measurement (or testing by the one of the thermistors 150) and transfers the data to the microcontroller unit for confirmation. The second thermistor of the thermistors 150 is used to monitor the data generated by the first thermistor of the thermistors 150. When the first data measured by the first thermistor deviates, the data is corrected using the data received from the second thermistor to ensure the accuracy of the data received from the first thermistor.

Therefore, in general, two thermistors are placed at the air outlet. The first thermistor is used to sense a first temperature and the second thermistor is used to sense a second temperature. The temperature measured by the first thermistor is compared to the temperature measured by the other thermistor, and the data is calibrated to ensure that the temperature of the air flow at the air outlet can be more constant. Specifically, the controller coupled with the first thermistor and the second thermistor the controller is configured to regulate a temperature of the heating wire based on comparison between the first temperature and the second temperature. In an example embodiment, the thermistors may perform 99 temperature detections per second to provide the constant temperature of the air flow at the air outlet.

In an example embodiment, the temperature analysis and control may be provided by infrared remote temperature measurement technology or by artificial intelligence.

The heating wire 108 may further have an ion producing electrode 1302 for ionizing the air flow exiting the air outlet and preventing the creation of the static electricity when blowing on hair. The ion producing electrode 1302 may have a first part 1304 located parallel to an outer circular surface 1306 of the heating wire 108 and a second part 1308 inclined at about 45 degrees with respect to the first part 1304 towards a center of the heating wire 1308.

Figure 14B:
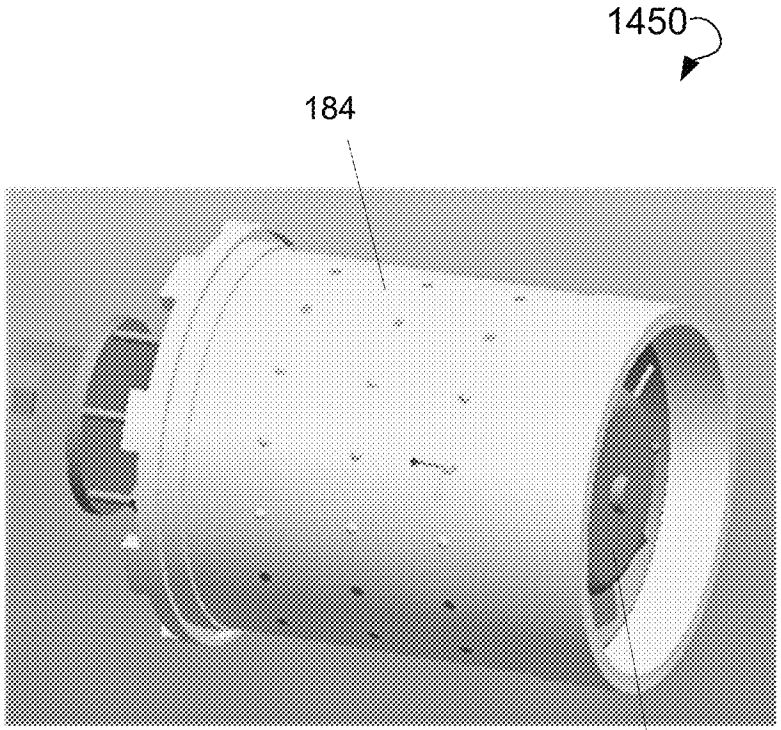
FIGS. 14A and 14B are general views of a gasket, according to an example embodiment.
Figure 14A:
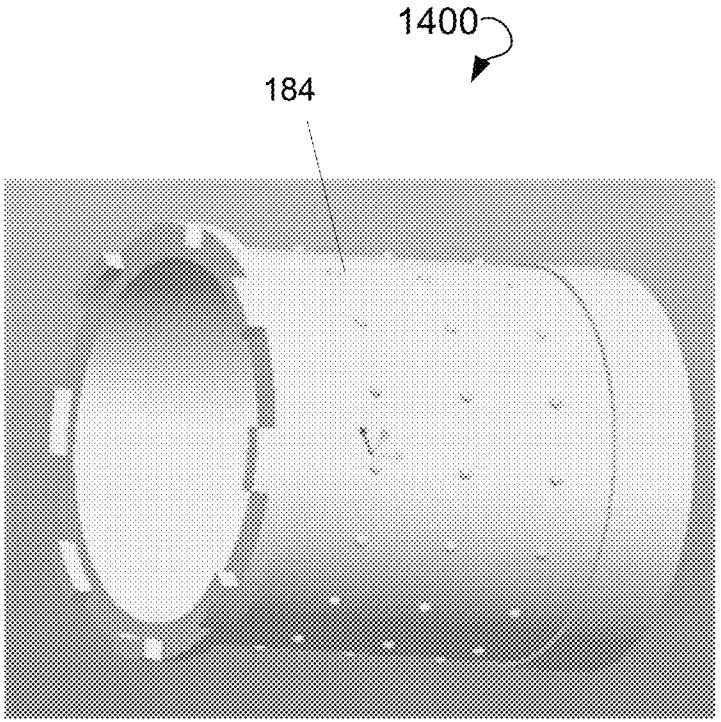

FIGS. 14A and 14B are general views 1400, 1450, respectively, of a gasket 1402. The gasket 184 may cover the electric ventilator 106 to fix the electric ventilator 106 to the handle. The gasket 184 may be placed between the electric ventilator 106 and the motor hold 106 as shown in FIG. 1. The gasket 184 may be made of a silicon. The silicon gasket may be configured to reduce startup noise of the electric ventilator and reduce the vibration of the motor, especially when the motor starts to run. Therefore, the gasket 184 absorbs the vibration caused by the high-speed movement of the motor and reduces the noise generated by the motor.

Figure 15:
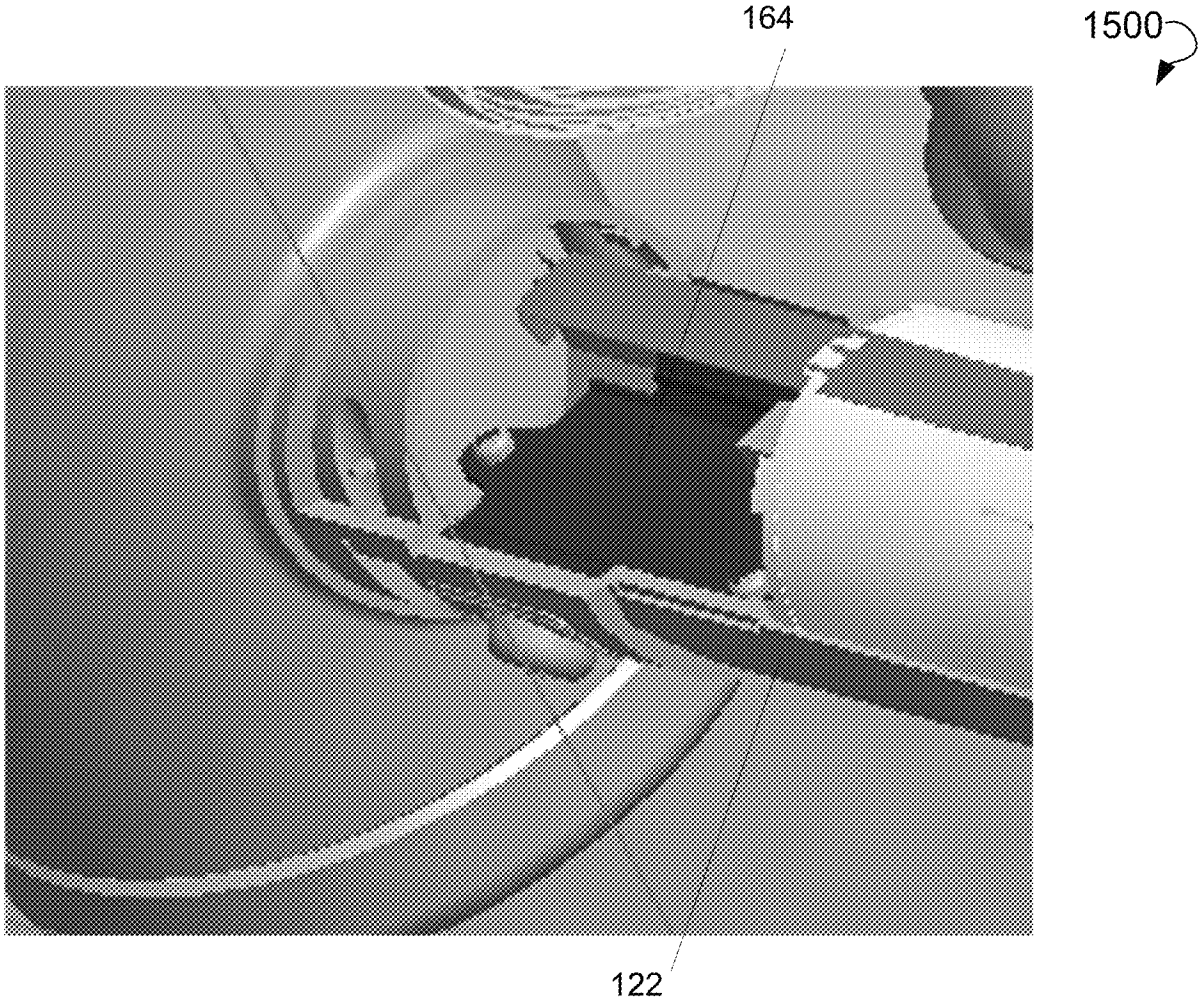
FIG. 15 is a general view of a pressure plate, according to an example embodiment.

FIG. 15 is a general view 1500 of a pressure plate 164 configured to fix the slide switch and buttons to the handle. Additionally, the power cord can be at least partially passed through the pressure plate, such as through the underside of the pressure plate 164, thereby avoiding appearance of foreign objects in an air duct inside the handle. The pressure plate 164 may reduce the noise caused by the air flow. Moreover, the bottom of the pressure plate 164 may be directly welded to the inner surface of the first housing part 122 of the handle to avoid connecting the pressure plate 164 via wires and reduce the wire connections inside the handle.

In an example embodiment, the hair dryer assembly may have a plurality of protective functions. After the hair dryer assembly runs automatically for 15 minutes, hair dryer assembly may be automatically powered off to prevent hazards if the hair dryer assembly left unattended. When the air inlet or air outlet is blocked by objects, the hair dryer assembly may automatically stop working. All materials from which the elements of the hair dryer assembly are made may be fireproof so that even if the hair dryer assembly is short-circuited, the hair dryer assembly will not cause danger.

Figure 16:
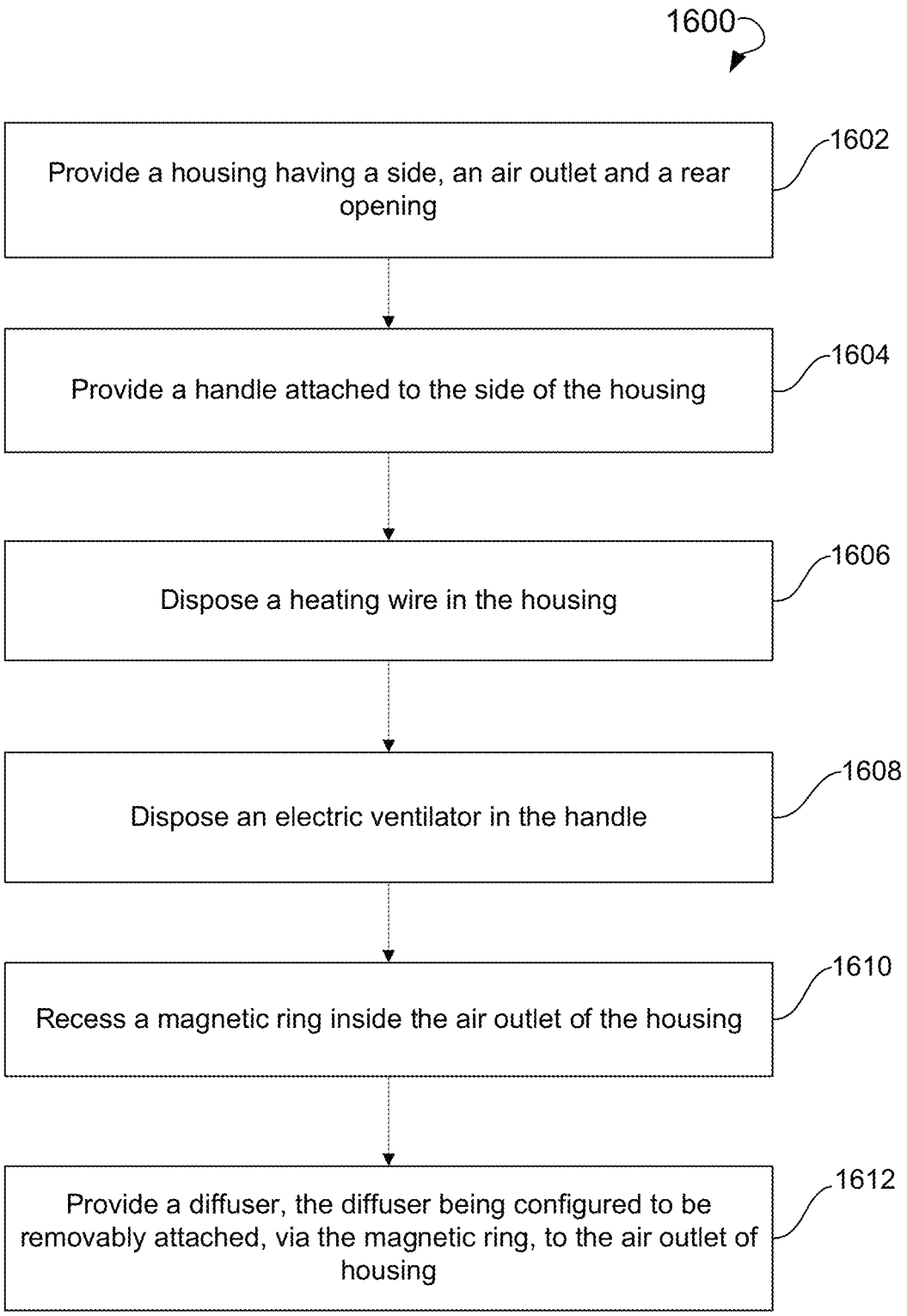
FIG. 16 is a flow chart showing a method for providing a hair dryer assembly, according to some example embodiments.

FIG. 16 is a flow chart showing a method 1600 for providing a hair dryer assembly, according to some example embodiments. The method 1600 may commence, in block 1602, with providing a housing having a side, an air outlet, and a rear opening. In block 1604, the method 1600 may include providing a handle attached to the side of the housing. A shape of an inner wall of the handle may include concave arcs disposed around a central axis of the handle. The concave arcs may form a space to absorb a sound of the electric ventilator.

In block 1606, the method 1600 may include disposing a heating wire in the housing. In block 1608, the method 1600 may include disposing an electric ventilator in the handle. A rotational axis of the electric ventilator may coincide with a central axis of the handle. In block 1610, the method 1600 may include recessing a magnetic ring inside the air outlet of the housing.

In block 1612, the method 1600 may include providing a diffuser configured to be removably attached, via the magnetic ring, to the air outlet of housing. The diffuser may include an air inlet, an air outlet, and a HEPA filter disposed between the air inlet and the air outlet. The diffuser may include a plate and nozzles extending orthogonally from the plate. The nozzles may include air flow outlets configured to form an air flow tangentially with respect to the plate and around a central axis of the plate.

In an example embodiment, the method 1600 may include providing a first rear cover and a second rear cover. The first rear cover may be assembled to the housing at the rear opening by screwing the first rear cover. The first rear cover may have a central opening. The method 1600 may include inserting the second rear cover into the central opening of the first rear cover to secure the first rear cover to the housing at the rear opening.

In an example embodiment, the method 1600 may include providing a fixing ring. The fixing ring may include a double-ring structure to reduce noise of the electric ventilator. The double-ring structure may include an inner ring, a hollow, and an outer ring. The method 1600 may include fixing, by the fixing ring, the electric ventilator within the handle.

Thus, a hair dryer assembly is described. Although embodiments have been described with reference to specific exemplary embodiments, it will be evident that various modifications and changes can be made to these exemplary embodiments without departing from the broader spirit and scope of the present application. Accordingly, the specification and drawings are to be regarded in an illustrative rather than a restrictive sense.

What is claimed is:

1. A hair dryer assembly comprising:

a housing having a side, an air outlet and a rear opening;

a handle attached to the side of the housing;

a heating wire disposed in the housing;

an electric ventilator disposed in the handle;

a magnetic ring recessed inside the air outlet of the housing;

a diffuser removably attached, via the magnetic ring, to the air outlet of the housing;

a first thermistor and a second thermistor disposed at the air outlet, the first thermistor being used to sense a first temperature and the second thermistor being used to sense a second temperature; and a controller coupled with the first thermistor and the second thermistor, wherein the controller is configured to regulate a temperature of the heating wire based on a comparison between the first temperature and the second temperature.

2. The hair dryer assembly of claim 1, further comprising:

a first rear cover, the first rear cover assembled to the housing at the rear opening by screwing, the first rear cover having a central opening; and a second rear cover inserted into the central opening of the first rear cover to secure the first rear cover to the housing at the rear opening.

3. The hair dryer assembly of claim 1, further comprising a fixing ring, wherein the fixing ring is configured to fix the electric ventilator within the handle, the fixing ring including a double-ring structure to reduce noise of the electric ventilator, the double-ring structure including an inner ring, a hollow, and an outer ring.

4. The hair dryer assembly of claim 1, wherein the diffuser includes an air inlet, an air outlet, and a high-efficiency particulate air filter disposed between the air inlet and the air outlet.

5. The hair dryer assembly of claim 1, wherein a shape of an inner wall of the handle includes concave arcs disposed around a central axis of the handle, the concave arcs to form a space to absorb a sound of the electric ventilator.

6. The hair dryer assembly of claim 1, further comprising three temperature protection resistors configured to monitor temperature of the heating wire, the three temperature protection resistors being disposed around an axis of the heating wire with 120 degree from each other.

7. The hair dryer assembly of claim 1, wherein the electric ventilator is fixed to the handle via a silicon gasket, the silicon gasket being configured to reduce startup noise of the electric ventilator.

8. The hair dryer assembly of claim 1, further comprising a first metal shrapnel plate and a second metal shrapnel plate to provide an electric current to the heating wire, the first metal shrapnel plate being molded into a first part of the handle and the second metal shrapnel plate being molded into a second part of the handle, the second part being opposite to the first part.

9. The hair dryer assembly of claim 1, wherein a rotational axis of the electric ventilator coincides with a central axis of the handle.

10. The hair dryer assembly of claim 1, further comprising:

a slide switch;

a pressure plate configured to fix the slide switch to the handle; and a power cord passing, at least partially, through the pressure plate.

11. The hair dryer assembly of claim 1, wherein the diffuser includes a plate and nozzles extending orthogonally from the plate, the nozzles including air flow outlets configured to form an air flow tangentially with respect to the plate and around a central axis of the plate.

12. A method for providing a hair dryer assembly, the method comprising:

providing a housing having a side, an air outlet, and a rear opening;

providing a handle attached to the side of the housing;

disposing a heating wire in the housing;

disposing an electric ventilator in the handle;

recessing a magnetic ring inside the air outlet of the housing;

providing a diffuser configured to be removably attached, via the magnetic ring, to the air outlet of the housing;

providing a first thermistor and a second thermistor disposed at the air outlet, the first thermistor being used to sense a first temperature and the second thermistor being used to sense a second temperature; and providing a controller coupled with the first thermistor and the second thermistor, wherein the controller is configured to regulate a temperature of the heating wire based on a comparison between the first temperature and the second temperature.

13. The method of claim 12, further comprising:

providing a first rear cover, the first rear cover being assembled for the housing at the rear opening by screwing, the first rear cover having a central opening;

providing a second rear cover; and inserting the second rear cover into the central opening of the first rear cover to secure the first rear cover to the housing at the rear opening.

14. The method of claim 12, further comprising:

providing a fixing ring, the fixing ring including a double-ring structure to reduce noise of the electric ventilator, the double-ring structure including an inner ring, a hollow, and an outer ring; and fixing, by the fixing ring, the electric ventilator within the handle.

15. The method of claim 12, wherein the diffuser includes an air inlet, an air outlet, and a high-efficiency particulate air filter disposed between the air inlet and the air outlet.

16. The method of claim 12, wherein a shape of an inner wall of the handle includes concave arcs disposed around a central axis of the handle, the concave arcs forming a space to absorb a sound of the electric ventilator.

17. The method of claim 12, wherein the diffuser includes a plate and nozzles extending orthogonally from the plate, the nozzles including air flow outlets configured to form an air flow tangentially with respect to the plate and around a central axis of the plate.

18. The method of claim 12, wherein a rotational axis of the electric ventilator coincides with a central axis of the handle.

19. A hair dryer assembly comprising:

a housing having a side, an air outlet, and a rear opening;

a handle attached to the side of the housing;

a heating wire disposed in the housing;

an electric ventilator disposed in the handle, a rotational axis of the electric ventilator coinciding with a central axis of the handle;

a first rear cover, the first rear cover assembled for the housing at the rear opening by screwing, the first rear cover having a central opening;

a second rear cover inserted into the central opening of the first rear cover to secure the first rear cover to the housing at the rear opening;

a magnetic ring recessed inside the air outlet of the housing;

a diffuser removably attached, via the magnetic ring, to the air outlet of the housing, wherein the diffuser includes a plate and nozzles extending orthogonally from the plate, the nozzles including air flow outlets configured to form an air flow tangentially with respect to the plate and around a central axis of the plate; and three temperature protection resistors configured to monitor a temperature of the heating wire, the three temperature protection resistors being disposed around an axis of the heating wire at an angle of 120 degrees to each other.

* * * * *